United States Patent [19]

Nelson

[11] Patent Number: 5,005,836

[45] Date of Patent: Apr. 9, 1991

[54] GOLF DRIVING AND PUTTING EXERCISER AND TRAINING AID

[76] Inventor: Steven Nelson, 52-900 Diaz, LaQuinta, Calif. 92253

[21] Appl. No.: 381,838

[22] Filed: Jul. 19, 1989

[51] Int. Cl.[5] ..... A63B 69/36

[52] U.S. Cl. ..... 273/191 R; 273/188 R; 273/188 A

[58] Field of Search ..... 273/186 R, 187 R, 188 R, 273/188 A, 189 R, 191 R

[56] References Cited

U.S. PATENT DOCUMENTS

| | | | |
|---|---|---|---|
| 2,472,065 | 6/1949 | Cottingham | 273/191 R |
| 3,738,661 | 6/1973 | Moller | 273/189 |
| 4,381,111 | 4/1983 | Richards | 273/191 R |

FOREIGN PATENT DOCUMENTS

| | | | |
|---|---|---|---|
| 932757 | 8/1973 | Canada | 273/188 R |

*Primary Examiner*—Edward M. Coven
*Assistant Examiner*—Raleigh W. Chiu
*Attorney, Agent, or Firm*—Dennison, Meserole, Pollack & Scheiner

[57] ABSTRACT

A golf driving and putting exerciser and training aid is provided comprising an assembly of telescoping cylinders pivotally secured at one end to a supporting surface and provided with a driving fixture at the other end. The rate of retraction and extension of all cylinders is controlled by means of air pistons on the end of the cylinders. The training aid can be used to an angled vertical position to practice driving swings and in a horizontal position to practice putting strokes. Various attachments are provided to achieve flexibility in mounting and applications.

20 Claims, 4 Drawing Sheets

GOLF DRIVING AND PUTTING EXERCISER AND TRAINING AID

BACKGROUND OF THE INVENTION

This invention relates to a training and exercising apparatus which can be used to practice both driving and putting strokes. Proficiency in the game of golf requires constant practice to develop and maintain muscle tone, coordination, timing and form.

The apparatus of this invention can be used indoors or outdoors in a number of modes, thus enabling the golfer to keep to a regular schedule of training exercise.

A number of golf swing practice devices have been invented as typified by U.S. Pat. No. 3,083,016, issued Mar. 26, 1963, to L. W. Sumegi; U.S. Pat. No. 3,351,346, issued Nov. 7, 1967, to G. M. Strahan; U.S. Pat. No. 3,999,765, issued Dec. 28, 1976, to F. M. Bishop; and U.S. Pat. No. 4,486,020, issued Dec. 4, 1984, to B. T. Kane et al. In Sumegi, a long spring device is fixed to a platform on one end and is provided with a handle on the other end. The platform has indicia to indicate proper feet placement. The golfer stands on the platform and practices golf swings by grasping the handle and expanding and retracting the spring in a simulated golf swing motion. Strahan shows a golf swing training device employing a short curved handle with a weight mounted near the end. In practice, the action of the weight helps the golfer develop an "inside-out" swing. Bishop shows a golf swing training apparatus having an elevated tee mounted on a platform with foot aligning cutouts. The golfer practices with a short-shafted weighted golf club. Kane et al show a golfer's swing practice device having a rigid swing control rod pivotally attached to a wall on one end and pivotally attached to a golf club at the other end. The golfer practices swings in a plane guided by the swinging rod.

While the above-mentioned patents do teach golf swing practice devices, the prior art does not teach a practice device having the flexibility of use and diverse modes of operation as in the instant invention.

SUMMARY OF THE INVENTION

The overall object of the invention is to provide a golf swing training device which is convertible for use in a golf driving mode as well as a putting mode. In order to provide this flexibility, the invention includes multiple mounting attachments enabling use in many environments.

It is another object of the invention to provide a golf driving and putting exerciser and training aid for off-course and off-season use to strengthen a golfer's golf swing with teaching features in respect of timing, rhythm and positions of the club during the swing.

The training aid of this invention is built around a series of telecoping cylinders pivotally secured at one end to a supporting surface and provided with a driving handle at the other end.

In a golf driving mode of operation, the telescoping cylinders are extended in an angled vertical direction to the backswing position. During the downswing, the cylinders are collapsed with a controlled amount of resistance to provide the necessary "feel" as in a regular golf swing. The cylinders also act in the manner of a collapsing guiding rod to confine the golf swing in a desirable swing pattern.

In a putting mode of operation, the cylinders are deployed horizontally on a surface and supported at one end. A putting attachment is secured on the other end and a putter is affixed thereto. Putting strokes are practiced with the putter by retracting and extending the cylinders under controlled conditions

DESCRIPTION OF THE PREFERRED EMBODIMENT

Figure 2:
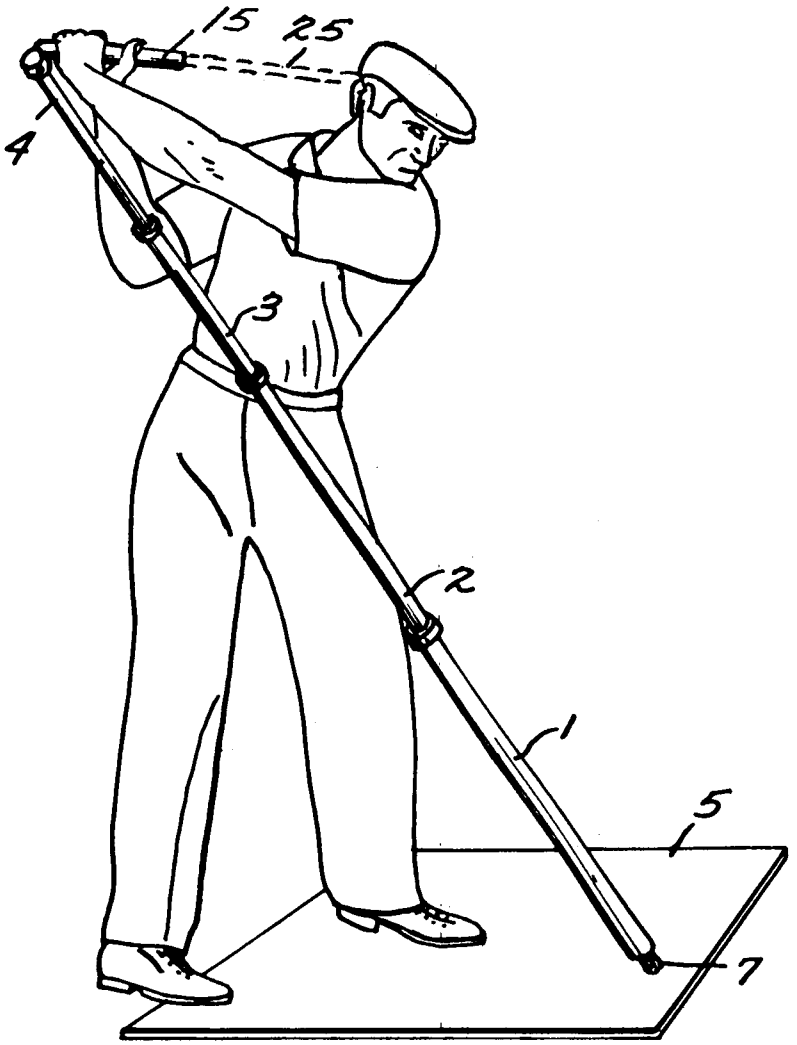
FIG. 2 is a perspective view showing a golfer using the invention in the backswing position.
Figure 1:
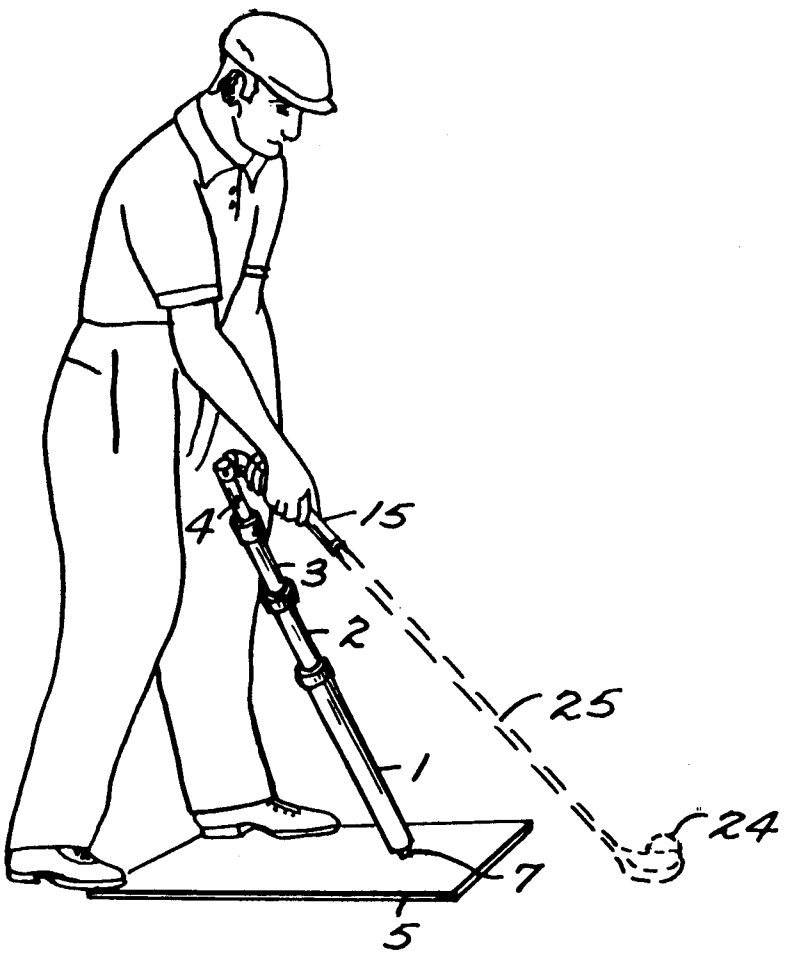
FIG. 1 is a perspective view showing a golfer using the invention in a ball addressing position.
Figure 3:
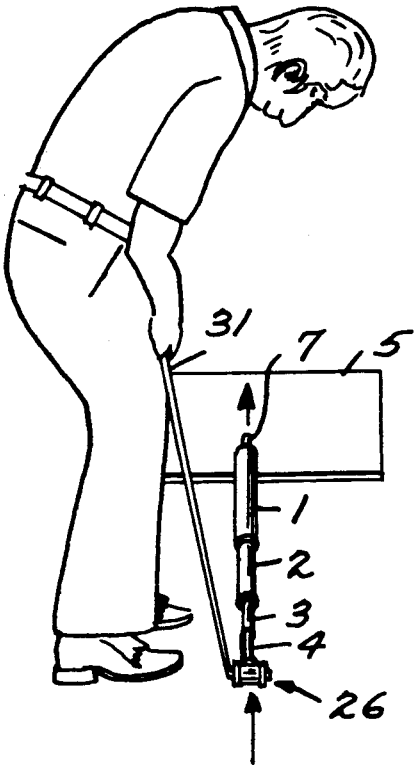
FIG. 3 is a perspective view showing a golfer using the invention in a putting position.

Referring now in general to the drawings, and in particular to FIGS. 1–3, the novel golf swing practice device is formed of a series of nesting telescoping cylinders comprising a first cylinder 1 of maximum diameter, second and third intermediate cylinders 2, 3 of decreasing diameter and a last cylinder 4 of smallest diameter.

Figure 6:
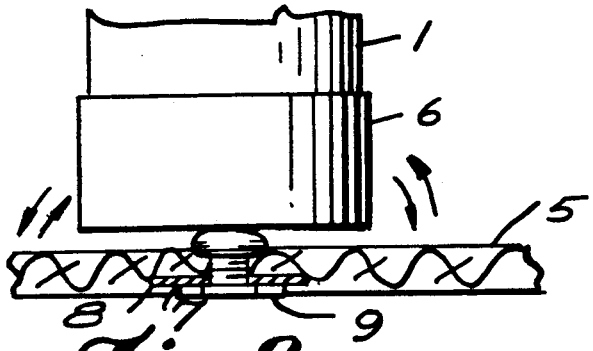
FIG. 6 is a side view showing the invention attached to a carpet.
Figure 8:
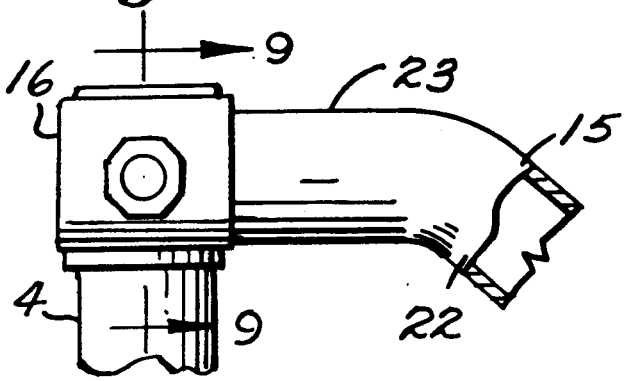
FIG. 8 is a side view of the golf swing practice
Figure 9:
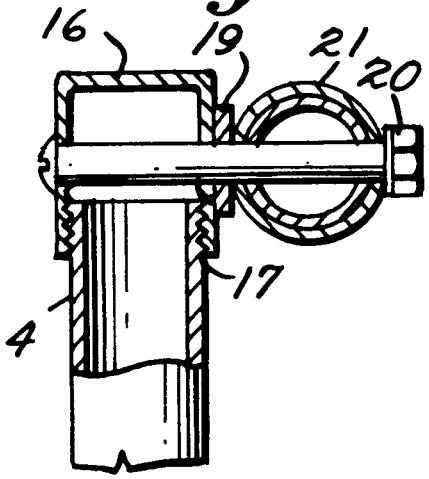
FIG. 9 is a sectional view of the practice handle attachment taken along line 9—9 of FIG. 8.

The closed end of the first cylinder 1 is pivotally secured to a section of carpet 5 in the manner shown in FIG. 6. A cap 6 closing off first cylinder 1 has affixed thereto a centrally mounted threaded stud 7. The stud is inserted in a hole in the carpet and attached by means of a washer 8 and nut 9. As shown in FIGS. 1 and 2, the attachment point of cylinder 1 is at a generally forward location on the carpet to provide ample room for the feet of the golfer.

FIG. 3 shows the cylinders rotated forwardly with respect to FIG. 2 around the pivot point at 7 to lie in a horizontal position to serve in a putting mode of operation. The carpet will bulge up slightly around the attachment point 7, 9, but the carpet will generally lie flat to keep the cylinders from moving out of position.

Figure 5:
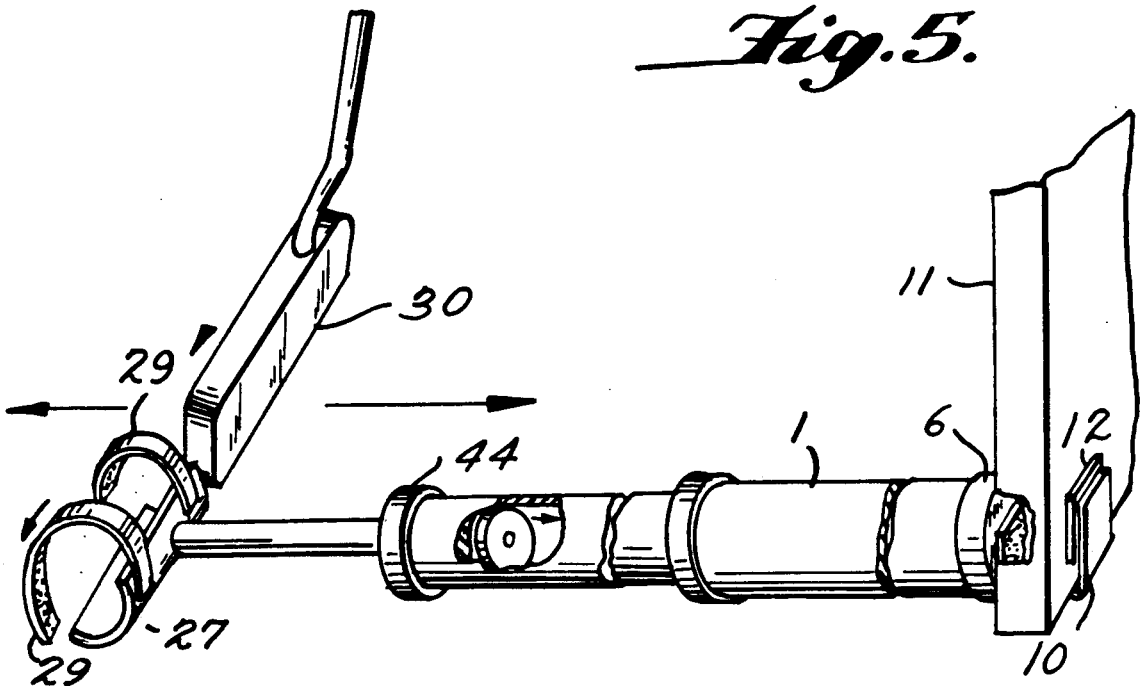
FIG. 5 is a perspective view showing the invention attached to a door for use in a putting position.

FIG. 5 shows an attachment which enables the invention to be used indoors using the floor and door of a room. A Velcro strap 10 is secured to end cap 6 and inserted under door 11 and joined to mating Velcro patch 12 fixed to the other side of the door. When the door is closed, the first cylinder is secured against movement.

Figure 7:
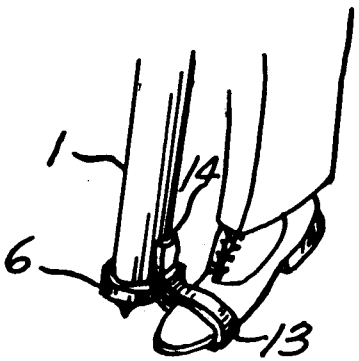
FIG. 7 is a perspective view showing the invention attached to the foot of a golfer; handle.

FIG. 7 shows an attachment employing the foot of a golfer as the supporting surface in a golf driving mode. A Velcro strap 13 is secured to an end portion of first cylinder 1 in the vicinity of cap 6 and looped around the foot of the user. The loop is closed when strap 13 is secured to a Velcro patch 14 bonded to cylinder 1.

Implements for extending and retracting the cylinders are attached to an end portion of the last cylinder 4. FIGS. 1, 2, 8 and 9 show a handle to practice driving swings. The practice handle 15 is connected to last cylinder 4 by means of a cap 16 which is screwed onto a mating thread 17 provided at the end of cylinder 4. Cap 16 mounts a pin 18 which in turn rotatably supports handle 17 for rotation between washer 19 and nut 20. A short cap 21 is provided for additional support where pin 18 extends through the handle. Although a threaded connection is shown, any quick connecting coupler may be used to attach the implements.

Practice handle 15 is provided with an angular bend 22 of about 40 degrees between a short connecting portion 23 and the main gripping portion of the handle. The purpose of the bend 22 is to help set the club at the correct angle at the top of the backstroke.

The pin connection 18 also aids in setting the proper backstroke angle. In addition, the pin helps to roll the club over after the swing. However, it should be mentioned that other connections, such as a ball and socket or a universal joint, may also be used at this location for the same purpose.

FIG. 1 shows a golfer gripping the practice handle 15 in a classical driving hand grip. The golfer is shown addressing the ball 24 prior to the backswing. A golf club 25 is shown in phantom to illustrate the aiming of the handle 15. Although the use of a regulation size golf club extending from the handle 15 is not practical for indoor driving practice, under certain outdoor conditions a regulation golf club may be employed. However the invention will be described in terms of using handle 15 as a simulated golf club for practicing driving swings.

In the ball addressing mode shown in FIG. 1, the telescoping sections 1–4 are generally centrally located around pivot stud 7 with the sections slightly extended to adjust for the golfer's height.

FIG. 2 shows the golfer at the top of the backswing. The handle has been swung upwardly to the right from the FIG. 1 position to come to rest across the right shoulder. The telescoping sections have been extended in accordance with the height and reach of the golfer. The angular bend 22 and pivoting connection at 18 aid in maintaining proper grip and angular position.

From the top of the backswing position, the practice handle 15 is swung downwardly in a simulated ball striking position. The cylinders are retracted and begin pivoting toward the left side of the golfer. At the simulated ball striking position in the downswing, the cylinders are at maximum retraction and thereafter begin to extend again as the swing goes into the follow through. Throughout the entire swing, the action is controlled by the linear rigidity in the retracting and expanding cylinders pivoting around a single pivot which confines the swing in a substantially common plane. The cylinders act in the manner of a rigid but telescoping guiding stick. The pivoted joint at 18 provides for proper wrist action and rollover.

In order to compensate for the mass of the missing driving club, a predetermined amount of compensating friction must be designed into the telescoping sections. This feature will be described in connection with FIGS. 10–13 below.

Figure 4:
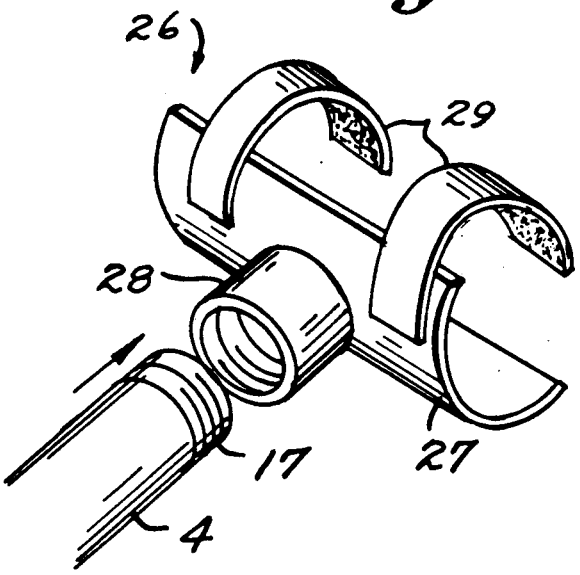
FIG. 4 is an enlarged perspective view of a fixture to attach the head of a putter to the invention.

FIGS. 3, 4 and 5 show operation of the invention in a putting mode. FIG. 4 shows a putting fixture 26 for securing the head of a putter in stroking relationship with telescopic sections 1–4. Fixture 26 comprises a curved retaining plate 27 having an internally threaded mounting coupler 28 secured on its convex side. The coupler is attached to mating threads 17 on the end of the last cylinder 4. Bonded to an upper side of plate 27 are a pair of Velcro straps 29 which are arranged to extend across the open side of the curved retaining plate 27 to be attached to a mating Velcro patch (not shown) on the underside of the plate 27.

In use, the head 30 of a golf putter is inserted within retainer 27 and strapped into place by straps 29. The design can accommodate most putters.

FIG. 3 shows a golfer practicing putting strokes with the cylinders lying in a horizontal position. The head of putter 31 is strapped into retainer 26 and as the golfer strokes the putter, the retainer will force the cylinders to retract in accordance with the length of stroke. Note how the linear rigidity of the telescoping cylinders aids in maintaining a linear putting stroke.

As in the driving embodiment of FIG. 2, a controlled amount of friction between the cylinders is necessary for best operation and to develop good muscle tone. The structure to develop this friction will now be described.

Figure 10:
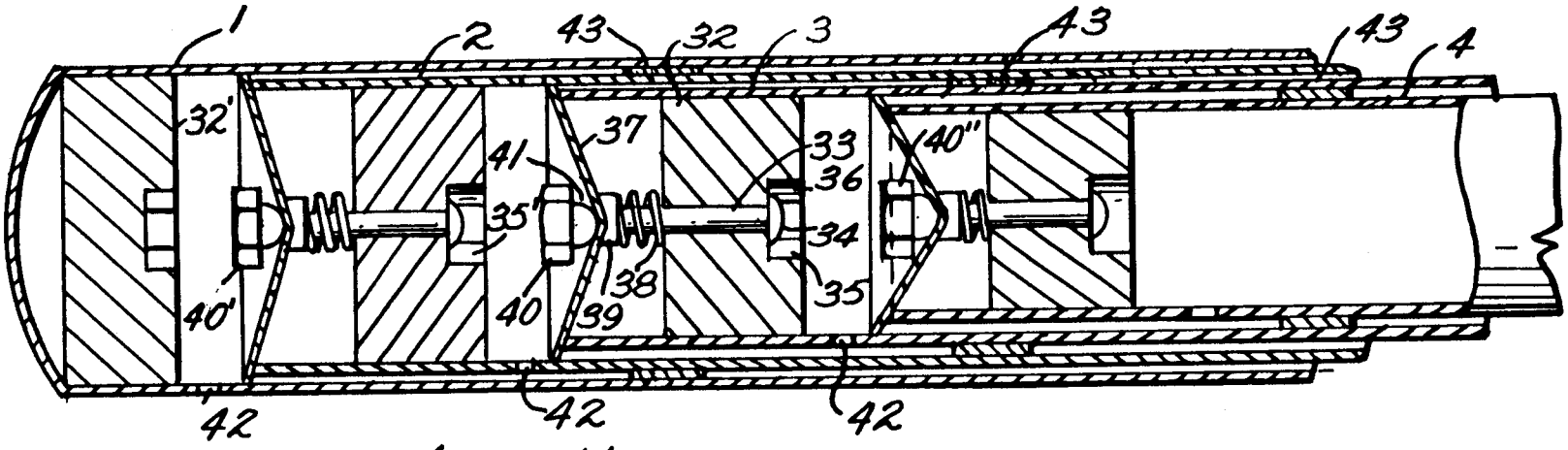
FIG. 10 is a cross-sectional view of the cylinders and pistons in a retracted position.

FIG. 10 shows cylinders 1–4 in a retracted nested position. Sliding friction between the cylinders is provided by means of air pistons formed on the ends of cylinders 2, 3 and 4. Since the pistons are similar, the piston at the end of cylinder 3 will be described in detail bearing in mind that the remaining pistons differ only in relative size. The same reference numerals followed by primes will be used where necessary to identify common elements in cylinders 2 and 4.

A block 32 of wood, plastic or any suitable material is inserted near an end portion of cylinder 3 to lie in fixed, pressure tight relationship with respect to the cylinder. A bolt 33 is centrally mounted in pressure tight relationship within block 32 to extend forwardly thereof. The head 34 of the bolt is mounted within a recess 35 provided in the surface of the block. The recess is provided with flats 36 to serve in the manner of a socket wrench.

A generally cone-shaped flexible washer 37 is mounted on bolt 33 to serve as a piston. The piston 37 overlaps the end of cylinder 3 and contacts the internal surface of adjacent cylinder 2 with a predetermined amount of pressure. This pressure is determined by means of spring 38 and washer 39 acting between the block and washer on one side of the piston and nut 40 and washer 41 on the other side. Threading the nut upwardly on the bolt causes the piston cone angle to increase against the spring pressure reducing the frictional contact against the cylinder wall.

The nut 40 can be adjusted by pushing cylinder 3 forwardly until the nut engages socket recess 35' where it is held fixed while the cylinder is rotated. In similar fashion, nut 40'' of cylinder 4 can be adjusted by driving it into recess 35 of cylinder 3. A bottom block 32' in the first cylinder provides for the adjustment of nut 40' in cylinder 2.

It can be seen that retracting movement of cylinder 3 will drive piston 37 forwardly to compress the air in cylinder 2. Air bleed holes 42 are provided to relieve the pressure generated by the piston and thereby affect the force required to retract the piston. The total force required for piston retraction depends on the sliding friction between the piston 37 and its associated cylinder plus the force required to push the air out of bleed hole 42. Both of these forces are controlled by the adjustment nut 40.

Cylinder extension requires somewhat less total force because a certain amount of air blowby occurs around piston 37 when moved in the backward direction.

The intermediate and last cylinders are provided with stop bands 43 to limit axial retraction of the cylinders. These stop bands abut collars 44 which are mounted on the end of each cylinder. The collars also serve as bearings to guide the cylinders in their telescopic extension and retraction.

Figure 11:
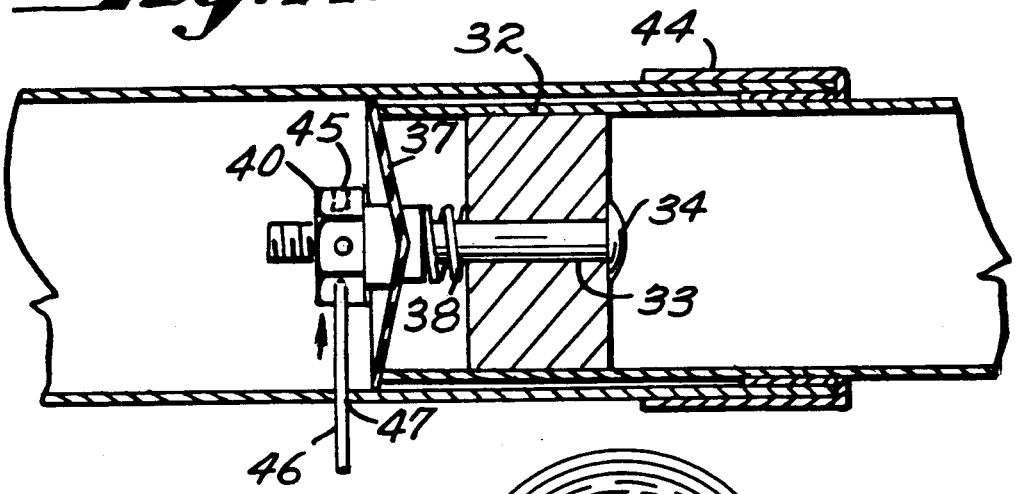
FIG. 11 is a view of an alternate embodiment for adjusting the piston cone angle.
Figure 12:
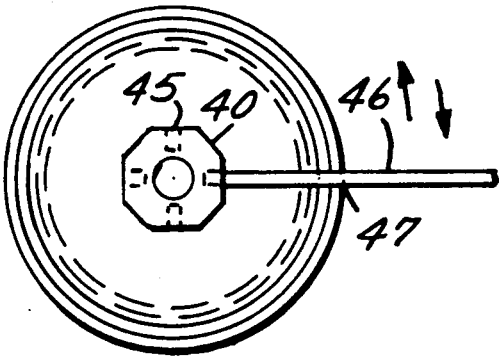
FIG. 12 is an end view of the adjustment device shown in FIG. 11.

FIGS. 11 and 12 show an alternate scheme for adjusting the cone angle of piston 37. The same references as used in FIG. 10 will be used here to describe common elements. Instead of the socket recess 35 in block 32, the head 34 of bolt 33 lies on the surface of block 32. Adjusting nut 40 has a plurality of holes 45 drilled into its flats. Holes 45 receive a stop pin 46 through access openings 47 drilled into an upper portion of each cylinder. The stop pin 46 maintains the nut 40 stationary while the cylinder is rotated to change the cone angle as described in connection with FIG. 10.

Figure 13:
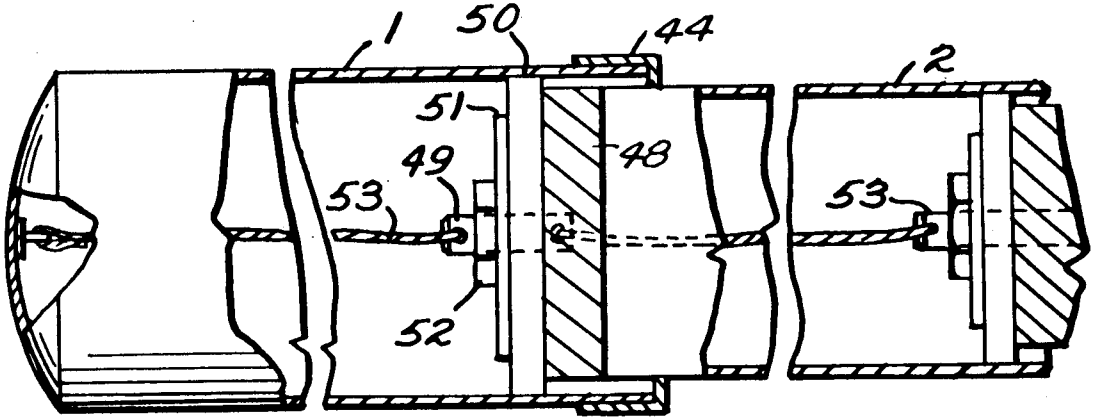
FIG. 13 is a cross-sectional view of another embodiment of the cylinders and pistons in a retracted position.

An alternate embodiment of the invention is shown in FIG. 13. A block 48 of wood, plastic or any suitable material is inserted at the end of each cylinder to be in fixed, pressure tight relationship therewith. A threaded stud 49 centrally mounted in block 48 supports a flexible disc 50. The disc 50 is held against block 48 by means of washer 51 and nut 52.

Frictional force in this case is adjusted by turning nut 52 and expanding disc 50 against the internal wall of cylinder 1. The disc 50 is designed to permit controlled air blowby instead of exhausting the air through a bleed port as in FIG. 10. The force necessary to drive the piston forward is the sum of the frictional force of disc 50 acting against cylinder 1, plus the force necessary to effect blowby of the air in the cylinder.

Another feature of the FIG. 13 embodiment is the provision of a flexible strand connection 53 between adjacent cylinders. The connecting strands limit extension of the cylinders and provide a more cushioned stop as compared to the stop bands 43 in the FIG. 10 embodiment.

It is not intended to limit the present invention to the details of illustration or terms of description of the embodiments shown above. It will be appreciated by those skilled in the art that various modifications and alterations therein may be made within the scope of the present invention.

I claim:

1. A golf swing training apparatus comprising multiple sections telescopically mounted for extensible and retractable sliding motion with respect to each other in the direction of their length, means at one end of said sections to secure said sections to a supporting surface with limited movement relative thereto, means at the other end of said sections to mount a golf swing force transmitting fixture, and friction means responsive to the force transmitted by said fixture to control said sliding motion between said sections.

2. The apparatus as claimed in claim 1 wherein said securing means comprises a stud extending from said one end of said sections, and said supporting surface comprises a section of carpet, said stud extending through a hole in said carpet and secured thereto by a fastening means.

3. The apparatus as claimed in claim 1 wherein said securing means comprises a Velcro strap secured to said one end of said sections, and said supporting surface comprises the foot of the golfer, said strap looped around said foot and secured to a mating Velcro strip fixed to said one end of said sections.

4. The apparatus as claimed in claim 1 wherein said securing means comprises a Velcro strap secured to said one end of said sections, and said supporting surface comprises a door, said strap extending under said door and affixed to a Velcro strip attached thereto.

5. The apparatus as claimed in claim 1 wherein said force transmitting fixture comprises a driving handle simulating a golf club, said handle having an angular bend for setting a simulated golf club backswing angle, a cap for mounting said handle on said other end of said sections, and a pin for pivotally mounting said handle to said cap.

6. The apparatus as claimed in claim 1 wherein said force transmitting fixture comprises a curved retainer of a length to receive the driving head of a golf putter, at least one Velcro strap secured to said curved retainer to encircle said driving head and secure it within said curved retainer, and means to secure said curved retainer on said other end of said sections.

7. The apparatus as claimed in claim 1 wherein said multiple sections comprise a plurality of telescoping cylinders including a first cylinder, one or more intermediate cylinders and a last cylinder, said friction means comprising piston means at one end of said intermediate and last cylinders, said securing means being secured to an end portion of said first cylinder, and said golf swing force transmitting fixture being mounted don an end portion of said last cylinder.

8. The apparatus as claimed in claim 7 wherein said piston means comprises a cylindrical block fixed in pressure tight relationship near an end portion of each one or more intermediate cylinders and last cylinder, said block having a centrally mounted bolt extending therethrough, a recess in said block to receive the head of said bolt, a cone-shaped flexible piston mounted on said bolt, spring means on said bolt acting between said piston and block, nut adjustment means on said bolt acting on said piston opposed to said spring means whereby tightening of said nut adjustment means increases the cone angle of said cone-shaped flexible piston to reduce frictional contact with the adjacent cylinder wall.

9. The apparatus as claimed in claim 8 wherein said recess in said block is provided with socket flats to receive said nut adjustment means whereby said nut adjustment can be effected by driving said nut into said socket recess in said block and turning the associated cylinder.

10. The apparatus as claimed in claim 8 wherein said nut adjustment means comprises a nut having a plurality of driving holes drilled therein, access holes drilled in an upper portion of said cylinders, a pin insertable through the access hole into a hole drilled in said nut whereby the adjust nut is held stationary while the piston and cylinder are rotated to adjust the piston cone angle.

11. The apparatus as claimed in claim 8 wherein air bleed holes are provided in the cylinders near closed end portions thereof to permit controlled discharge of air pressure from the cylinders generated by piston movement.

12. The apparatus as claimed in claim 8 wherein each cylinder is provided with a combined end cap and bearing to support the next adjacent telescoping cylinder.

13. The apparatus as claimed in claim 12 wherein each one or more intermediate cylinders and last cylinder is provided with an encircling stop band to contact said end cap to limit telescopic extension.

14. The apparatus as claimed in claim 7 wherein said piston means comprises a cylindrical block fixed in pressure tight relationship at an end portion of each one or more intermediate cylinders and last cylinder, an elastic disc secured to said block, said disc extending beyond the periphery of said block to engage the adjacent cylinder wall with a predetermined pressure whereby the rate of piston air blowby determined by said predetermined pressure controls the rate of telescopic extension and retraction caused by said golf swing force transmitting fixture.

15. The apparatus as claimed in claim 14 wherein said elastic disc is supported on said block by means of a threaded stud, adjusting means on said stud acting to compress said disc against said block causing said disc to expand whereby the rate of piston blowby can be adjusted.

16. The apparatus as claimed in claim 15 wherein a flexible strand is internally attached to adjacent telescopic cylinders to limit the extension thereof.

17. The apparatus as claimed in claim 7 wherein an end portion of said last cylinder is threaded to accommodate diverse force transmitting fixtures.

18. A golf driving training method comprising the steps of:

assembling multiple sections of telescoping cylinders including a first cylinder, one or more intermediate cylinders and a last cylinder for extensible and retractable sliding motion with respect to each other in the direction of their length;

securing a golf swing force transmitting fixture at an end portion of said last cylinder;

providing piston friction means at one end of said intermediate and last cylinders responsive to the force transmitted by said fixture to control said sliding motion between said sections;

pivotally securing an end portion of said first cylinder of said telescoping sections to a section of carpet for limited movement relative thereto;

placing a foot on the carpet and grasping the force transmitting fixture with both hands in the manner of gripping the handle of a golf club;

swinging the hands upwardly into the backswing position carrying the handle into position across the shoulders while angularly extending the telescoping sections in one direction;

swinging the handle downwardly in a simulated ball striking movement while collapsing the cylinders; and continuing swinging the handle in a follow through position with the telescoping sections extending and being angularly positioned opposite to said one direction and with the handle coming to rest above the shoulder.

19. A golf putting training method comprising the steps of:

assembling multiple sections of telescoping cylinders including a first cylinder, one or more intermediate cylinders, and a last cylinder for extensible and retractable sliding motion with respect to each other in the direction of their length;

mounting of golf putting club retainer on an end portion of the last cylinder;

mounting a securing means at an end portion of said first cylinder;

providing piston friction means at one end of said intermediate and last cylinders responsive to the force transmitted by said putting club retainer to control said sliding motion between said sections;

placing the telescoping sections on a horizontal surface with said first section and securing means being secured to a support surface;

placing the driving head of a golf putting club in the retainer and securing the same thereto;

gripping the handle of the club and executing simulated putting strokes by retracting the cylindrical sections under the force transmitted by the golf putting club retainer.

20. The method of claim 19 wherein said horizontal surface is a floor of a room and said support surface is a door.

* * * * *